US010518964B2

(12) United States Patent
Yoshimura et al.

(10) Patent No.: US 10,518,964 B2
(45) Date of Patent: Dec. 31, 2019

(54) POLYSILICON PACKAGE

(71) Applicant: TOKUYAMA CORPORATION, Shunan-shi, Yamaguchi (JP)

(72) Inventors: Satoko Yoshimura, Shunan (JP); Takuya Asano, Shunan (JP)

(73) Assignee: TOKUYAMA CORPORATION, Shunan-shi (JP)

( * ) Notice: Subject to any disclaimer, the term of this patent is extended or adjusted under 35 U.S.C. 154(b) by 0 days.

(21) Appl. No.: 15/503,103

(22) PCT Filed: Sep. 18, 2015

(86) PCT No.: PCT/JP2015/076623
§ 371 (c)(1),
(2) Date: Feb. 10, 2017

(87) PCT Pub. No.: WO2016/047574
PCT Pub. Date: Mar. 31, 2016

(65) Prior Publication Data

US 2017/0233174 A1 Aug. 17, 2017

(30) Foreign Application Priority Data

Sep. 26, 2014 (JP) ..... 2014-196131

(51) Int. Cl.
*B65D 85/30* (2006.01)
*B65B 29/00* (2006.01)
(Continued)

(52) U.S. Cl.
CPC ..... *B65D 85/30* (2013.01); *B65B 29/00* (2013.01); *B65D 77/04* (2013.01); *B65D 77/08* (2013.01); *B65D 77/12* (2013.01)

(58) Field of Classification Search
CPC ..... B65D 85/30; B65D 77/04; B65D 77/08; B65D 31/04; B65D 31/08; B65D 81/03; B65B 29/00
(Continued)

(56) References Cited

U.S. PATENT DOCUMENTS 4,565,720 A * 1/1986 Yaeo ..... B32B 27/32 383/116
7,950,600 B2 * 5/2011 Gruebl ..... B02C 4/305 241/294
(Continued)

FOREIGN PATENT DOCUMENTS

CN 101376442 A 3/2009
CN 101678905 A 3/2010
(Continued)

OTHER PUBLICATIONS

Chinese Office Action and Search Report for Chinese Application No. 201580039661.8, dated Nov. 27, 2017, with English translation of the Chinese Office Action.
(Continued)

*Primary Examiner* — Chun Hoi Cheung
(74) *Attorney, Agent, or Firm* — Birch, Stewart, Kolasch & Birch, LLP

(57) ABSTRACT

A package in which a bag formed from a polyethylene-based resin film having a small thickness, more specifically a thickness of 300 μm or less is filled with crushed polysilicon (Si chunks) and damage to the bag by the Si chunks is effectively prevented.
In a polysilicon package in which the bag 1 formed from a polyethylene-based resin having an average thickness of 300 μm or less is filled with the Si chunks 4, the bag 1 has a heat-sealed bonded part 2 at the bottom and is filled with the Si chunks 4 to ensure that the maximum expansion of the
(Continued)

bag 1 becomes 5% or less when the bag 1 is held in an upright state with the bottom as a ground contact surface.

7 Claims, 2 Drawing Sheets

(51) Int. Cl.
*B65D 77/04* (2006.01)
*B65D 77/08* (2006.01)
*B65D 77/12* (2006.01)

(58) Field of Classification Search
USPC ..... 206/524.1; 383/37
See application file for complete search history.

(56) References Cited

U.S. PATENT DOCUMENTS 8,938,936 B2 * 1/2015 Vietz ..... B65B 1/32 141/83
9,550,607 B2 * 1/2017 Vietz ..... B65B 1/28
2009/0056279 A1 * 3/2009 Sasaki ..... B65D 31/04 53/449
2010/0154357 A1 6/2010 Wochner et al.
2012/0198793 A1 * 8/2012 Vietz ..... B65B 1/32 53/450
2013/0042582 A1 * 2/2013 Vietz ..... B65B 25/00 53/473
2013/0177266 A1 * 7/2013 Mack ..... B65D 33/01 383/203
2013/0269295 A1 * 10/2013 Mattes ..... B32B 9/045 53/428
2014/0130455 A1 * 5/2014 Lazarus ..... B65B 1/30 53/428
2014/0151259 A1 * 6/2014 Wochner ..... B29C 66/9241 206/524.1
2016/0167862 A1 * 6/2016 Lichtenegger ..... B65D 75/38 206/386

FOREIGN PATENT DOCUMENTS

CN 102951314 A 3/2013
DE 102012206251 A1 10/2013
JP 2561015 Y2 1/1998
JP 2006-143552 A 6/2006
JP 2010-36981 A 2/2010
JP 2010-528955 A 8/2010
JP 2012-101838 A 5/2012
JP 2014-108829 A 6/2014

OTHER PUBLICATIONS

Extended European Search Report dated Mar. 7, 2018 for corresponding European Application No. 15844223.6.
International Search Report for PCT/JP2015/076623 dated Dec. 22, 2015.
Written Opinion of the International Searching Authority for PCT/JP2015/076623 (PCT/ISA/237) dated Dec. 22, 2015.

* cited by examiner

POLYSILICON PACKAGE

TECHNICAL FIELD

The present invention relates to a polysilicon package containing crushed polysilicon which are used as a raw material for the production of semiconductors.

BACKGROUND ART

High-purity polysilicon is produced mainly by a Siemens process and used as a raw material for the production of a silicon single crystal used as a raw material of a semiconductor device. The Siemens process is a process in which a high-purity silicon seed (core wire) is electrically heated to react a silane-based gas with hydrogen on the surface of the seed for the vapor-phase growth of a high-purity polysilicon rod.

The polysilicon rod produced by the above Siemens process may be crushed, packaged or packed in the form of crushed polysilicon (may also be referred to as "Si chunks" hereinafter) which are block pieces and transported to a single crystal polysilicon production plant, etc.

After the above Si chunks are optionally etched to remove impurities on the surface, they are filled in a polyethylene-based resin film bag to prevent their contamination. The bag filled with the Si chunks, that is, a polysilicon package is generally packed in a transport case such as a cardboard box to be transported.

By the way, for the above bag filled with the crushed polysilicon, there is pointed out a problem that a sharp edge of a Si chunk as the content breaks through the package bag with the result that polysilicon is contaminated by contact with air when it is transported.

To solve the above problem, there are proposed some measures.

For example, there is known a package for containing polysilicon blocks, which has a double structure consisting of an inner bag and an outer bag so that contamination can be prevented with the outer bag if the inner bag is broken (refer to Patent Document 1). The above double package is effective and widely used in the industry.

However, in the case of the above double-package, damage to the inner bag must be prevented. Damage to the inner bag may cause damage to the outer bag.

To prevent damage to the bag filled with crushed polysilicon, it is conceivable that the polyethylene-based resin film constituting the bag should be thick. However, there is limitation to the prevention of damage to the bag by thickness. That, is, when the film is made too thick and an opening for filling is closed by heat-sealing after the crushed polysilicon are filled, thermal fusion by heat-sealing tends to become unsatisfactory, thereby deteriorating the sealability of the bag. In the case of a gusset bag in which a gusset is folded, the heat-sealability of a folded part becomes unsatisfactory with the result of the great deterioration of sealability. When a film forming the bag is too thick, the bag filled with the crushed polysilicon becomes bulky at the time of packing a transport case, thereby making efficient packing impossible.

Since only the control of the thickness of the bag causes another problem such as the deterioration of sealability or packing property, damage to the bag by the crushed polysilicon cannot be prevented effectively.

PRIOR ART DOCUMENT

Patent Document

Patent Document 1: Utility Model Registration No. 2561015

DISCLOSURE OF THE INVENTION

Problem to be Solved by the Invention

It is therefore an object of the present invention to provide a package in which a bag formed from a polyethylene-based resin film having a small thickness, more specifically a thickness of 300 μm or less is filled with Si chunks and damage to the bag by the chunks is effectively prevented.

Means for Solving the Problem

The inventors of the present invention conducted intensive studies to solve the above problem and found that when the bag is held in an upright state with a filling opening thereof facing up to fill Si chunks therein from the filling opening, Si chunks filled later are wedged into spaces between Si chunks filled before by strong force, for example, pressing force by human hands or force produced by acceleration of gravity when the Si chunks are mechanically dropped from above, whereby the wedged part of the film forming the bag is greatly expanded and a part made thinner by the expansion tends to be broken by the Si chunks. Based on this finding, damage to the bag can be prevented by controlling the means of filling the Si chunks in the bag so that this expansion is restricted, thereby accomplishing the present invention.

According to the present invention, there is provided a polysilicon package in which a bag formed from a polyethylene-based resin film having an average thickness of 300 μm or less is filled with crushed polysilicon, wherein the bag has a heat-sealed bonded part at the bottom and filled with the crushed polysilicon to ensure that the maximum expansion of the bag becomes 5% or less while it is held in an upright state with the bottom as a ground contact surface.

In the polysilicon package of the present invention, it is preferred that (1) the ratio ($h/L_1$) of the loading height "h" of the crushed polysilicon filled in the bag to the inner peripheral length "$L_1$" of the bag before the crushed polysilicon are filled should be 0.1 or more;

(2) the average maximum length of the above crushed polysilicon should be 5 to 150 mm; and (3) the polyethylene-based resin film forming the bag should have a thrust strength (JIS-Z1707) of 5 N or more.

According to the present invention, there is provided a polysilicon double package in which the above polysilicon package is sealed in an outer bag formed from a polyethylene-based resin film.

According to the present invention, there is further provided a process for producing a polysilicon package, comprising the steps of:

holding a bag formed from a polyethylene-based resin film having an average thickness of 300 μm or less in an upright state with a filling opening thereof facing up and the bottom thereof as a ground contact surface when crushed polysilicon are to be filled; and filling the crushed polysilicon from the filling opening to ensure that the maximum expansion of the bag does not become 5% or more.

In this production process, it is desired that the expansion of the bag at the time of filling the crushed polysilicon should be suppressed by inserting the bag into a frame to fill the crushed polysilicon.

Effect of the Invention

Since the thickness of the polyethylene-based resin film forming the bag of the polysilicon package of the present invention is 300 μm or less, the deterioration of sealability due to insufficient heat-sealing is effectively avoided.

Although the above film is thin, the local expansion of the bag caused by filling the polysilicon (Si) chunks is restricted, thereby effectively avoiding the deterioration of the thrust strength of the film by the expansion of the bag, whereby damage to the bag at an excessively expanded local part is effectively prevented, and the contamination of the Si chunks caused by damage to the bag is avoided, thereby making it possible to keep the purity of the crushed polysilicon at a high level.

The polysilicon package of the present invention produces the biggest effect when a bag made of linear low-density polyethylene (LLDPE) having high thrust strength and excellent pinhole resistance, especially metallocene-catalized LLDPE is used. Although the film made of such LLDPE has large expansion, the expansion of the bag caused by filling the Si chunks is restricted, whereby the pinhole resistance of LLDPE can be effectively utilized.

BEST MODE FOR CARRYING OUT THE INVENTION

Figure 1:
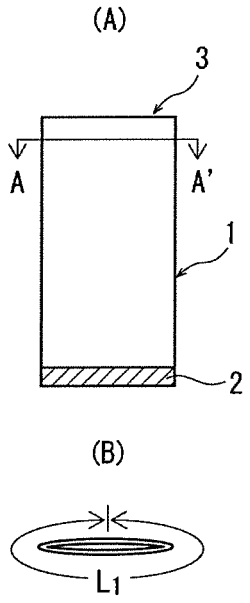
FIG. 1(A) is a side view of a typical bag (flat bag) used in the polysilicon package of the present invention.
FIG. 1(B) is a cross-sectional view cut on A-A'.

With reference to FIGS. 1(A) and 1(B) which show a bag used in the polysilicon package of the present invention, the bag represented by 1 as a whole has a heat-sealed bonded part 2 at the lower end when a polyethylene-based resin film is heat-sealed and a filling opening 3 for filling Si chunks in the bag 1 at the upper end.

The bag 1 shown in FIGS. 1(A) and 1(B) is a so-called "flat bag" and produced, for example, by heat-sealing one side end (lower end) of a tube-like film formed by extrusion molding.

As a matter of course, the bag 1 may be shaped like a gusset bag in which a gusset is formed and a fold is formed in this gusset or formed by sealing in three directions so that a heat-sealed bonded part is formed at both side ends in addition to the above lower end (2).

It is preferred from the viewpoint of filling a large amount of Si chunks that the bag 1 should be shaped like a flat bag or a gusset bag.

The inner peripheral length of the cavity part of this bag 1 is represented by $L_1$ as shown in FIG. 1(B). In FIG. 1(B), $L_1$ is depicted like outer peripheral length in the drawing of the figure in FIG. 1(B) but represents the inner peripheral length.

In the present invention, the thickness of the polyethylene-based resin film forming the bag 1 needs Lobe 300 μm or less, preferably 250 μm or less. That is, when this film is too thick and the filling opening 3 of the above bag 1 is closed by heat-sealing, the sealability of the bag 1 may deteriorate due to unsatisfactory heat welding. When the bag 1 is filled with the Si chunks and the package obtained by heat-sealing the above opening 3 is packed in a transport case such as a cardboard box, the package becomes bulky, thereby impairing the packing property of this package.

When the polyethylene-based resin film is too thin, it may be difficult to adjust the expansion which will be described hereinafter to a predetermined range, or there may occur a problem such as the great reduction of the strength of the bag 1. Therefore, the thickness of the film is generally 100 μm or more, particularly preferably 120 μm or more.

In the present invention, the polyethylene-based resin forming the above film is not particularly limited if it can be molded into a film having the above thickness. Examples of the resin include low-density polyethylene (LDPE) having a density of less than 0.930 g/cm$^3$, high-density polyethylene (HDPE) having a density of 0.930 g/cm$^3$ or more and linear low-density polyethylene (LLDPE) having a density of 0.910 to 0.925 g/cm$^3$. A blend of these may be used as well. These polyethylenes which generally have an extrusion-grade MFR, for example, an MFR of 5 g/10 min (190° C.) or less are used.

Further, the above polyethylene-based resin film has a thrust strength measured in accordance with JIS-Z1707 of 5 N or more, particularly preferably 7 N or more, at a thickness within the above range. Thereby, excellent pinhole resistance can be ensured.

To obtain a film having such high thrust strength with the above small thickness, the film is most preferably produced from linear low-density polyethylene (LLDPE), more specifically metallocene-catalized linear low-density polyethylene (metallocene-catalized LLDPE) obtained by polymerization using a metallocene-based catalyst.

That is, low-density polyethylene (LDPE) is obtained by polymerizing ethylene at a high pressure (about 1,000 to 4,000 atm) and a high temperature (about 100 to 350° C.) by using a radical initiator as a catalyst and may also be called "high-pressure produced polyethylene". In LDPE obtained by this method, the ethylene chain includes a long-chain branch, thereby causing a reduction in density and flexibility due to this structure. In contrast to this, LLDPE is obtained by copolymerizing small amounts of α-olefins (such as 1-butene, 1-hexene, 4-methylpentene-1 and 1-octene) with ethylene as a recurring unit and has a short branch randomly introduced thereinto, thereby causing a reduction in density. This LLDPE has a shorter branch and higher linearity of the molecule than LDPE. This LLDPE is excellent in impact resistance, pinhole resistance and sealability, and particularly LLDPE obtained by using a metallocene catalyst has a sharp molecular weight distribution, exhibits higher impact resistance, pinhole resistance and sealability and is therefore advantageous to the production of a film having high thrust strength and a film used to form a bag by heat-sealing.

Although the above LLDPE film, particularly metallocene-catalized LLDPE film is excellent in the above properties, it readily expands significantly. Therefore, when the bag 1 is produced from this film and the Si chunks are filled in the bag 1, the expansion of the bag 1 is large, thereby causing the deterioration of impact resistance and pinhole resistance due to thinning by expansion. However, since expansion at the time of filling the Si chunks is suppressed in the present invention, the characteristic properties of this LLDPE film are fully developed, thereby making it possible to effectively avoid damage to the bag caused by filling the Si chunks.

Further, in the present invention, it is desired from the viewpoint of preventing the contamination of the Si chunks filled in the bag 1 that the polyethylene-based resin forming the above film should have reduced contents of additives other than a resin component, such as fillers and antioxidants, especially metal compounds. It is particularly preferred that the resin should not be mixed with the above additives and that the film should be formed only from a resin component.

The Si chunks are filled in the bag 1 shown in FIGS. 1(A) and 1(B) formed from the above polyethylene-based resin film through the filling opening 3.

Figure 2:
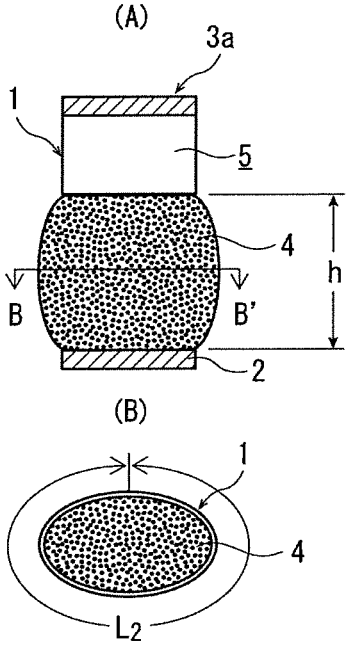
FIG. 2(A) is a schematic side view of the polysilicon package of the present invention in which Si chunks are filled in the bag.
FIG. 2(B) is a schematic sectional view cut on B-B'.

After the Si chunks are filled in the bag 1, the polysilicon package of the present invention having a form shown in FIG. 2(A) and FIG. 2(B) is obtained by closing the filling opening 3 by heat-sealing as required. In FIG. 2(A) and FIG. 2(B), a heat-sealed bonded part formed by closing the filling opening 3 by heat-sealing is represented by 3*a*, the Si chunks are represented by 4, and a head space (upper cavity) existent when the heat-sealed bonded part 3*a* is formed is represented by 5.

Although it is recommended to close the above filling opening 3 by heat-sealing, for example, when the unfilled part of the bag is very long, the bag can be sealed by folding this part.

With reference to FIGS. 2(A) and 2(B), in the polysilicon package of the present invention, the crushed polysilicon 4 are filled to ensure that the maximum expansion of the bag 1 becomes 5% or less, specifically 3% or less when the bag 1 filled with the Si chunks 4 is held in an upright state, that is, the heat-sealed bonded part 2 becomes the bottom and the heat-sealed bonded part 3*a* becomes the upper end.

This maximum expansion is calculated from the following equation.

$$\text{Maximum expansion (\%)}=((L_2-L_1)/L_1)\times 100$$

In the above equation, $L_1$ denotes the inner peripheral length of the cavity part of the bag 1 when it is not filled with the Si chunks 4 (see FIG. 1(B)), and $L_2$ denotes the inner peripheral length of the bag 1 at a part showing the maximum expansion while the bag 1 is filled with the Si chunks 4 and the filling opening 3 is closed by heat-sealing to form the heat-sealed bonded part 3*a* (cross section B-B' in FIG. 2(B)).

That is, in the present invention, the maximum expansion falling within the above range means that the local expansion of the bag 1 caused by filling the Si chunks 4 is greatly restricted with the result that the deterioration of characteristic properties such as thrust strength caused by the expansion of this bag 1 (polyethylene-based resin film) is effectively avoided, thereby effectively preventing damage to the bag caused by this expansion.

Although the size of the Si chunks 4 to be filled in the bag 1 is not particularly limited in the present invention, when Si chunks 4 having an average maximum length of 5 to 150 mm, specifically 30 to 110 mm, are filled, the present invention becomes most effective.

That is, when the Si chunks 4 as big as above are filled in the bag 1, along with the loading of the Si chunks 4, stress is applied outward to the bag 1. As Si chunks 4 are further filled, Si chunks 4 filled later are pressed into spaces between Si chunks filled and loaded before, whereby the bag 1 is spread out and expanded. This expansion deteriorates thrust strength and pinhole resistance, and a sharp edge of a Si chunk 4 tends to thrust the bag 1 by vibration at the time of filling or transport, thereby causing damage to the bag 1. Then, since this expansion at the time of filling is effectively suppressed in the present invention, the deterioration of characteristic properties caused by the expansion of the bag 1 can be effectively avoided, and damage caused by this expansion can be effectively prevented.

Meanwhile, the Si chunks 4 are obtained by crushing a polysilicon rod produced by the Siemens process mechanically, and chunks having a size larger than the above range are existent. Large Si chunks 4 are often packaged individually in most cases. In this case, as damage caused by the expansion of the bag 1 (polyethylene-based resin film) can be ignored, there is no point in applying the present invention.

When the Si chunks 4 are very small, for example, the average maximum length thereof is smaller than the above range, as the Si chunks 4 are densely filled in the bag 1, the amount of Si chunks 4 pressed into spaces between the loaded Si chunks 4 filled before is small and expansion caused by filling the subsequent Si chunks is relatively small. Further, since pressure is uniformly applied to the inner surface of the bag 1, local expansion hardly occurs. Therefore, damage to the bag 1 caused by filling the Si chunks 4 hardly occurs as well.

Thus, the polysilicon package of the present invention produces the most excellent effect when it is filled with the Si chunks 4 having an average maximum length within the above range.

Further, in the polysilicon package of the present invention, it is desired that the ratio ($h/L_1$) of the loading height "h" of the Si chunks filled in the bag 1 to the inner peripheral length "$L_1$" of the bag 1 before the Si chunks 4 are filled should be set to 0.1 or more.

That is, by setting the inner peripheral length "$L_1$" of the bag 1 to a large value and the height of the bag 1 to a small value so that the above ratio ($h/L_1$) becomes low, the maximum expansion of the bag 1 can be set to the above range. However, setting the inner peripheral length "$L_1$" of the bag 1 to a large value means that the installation space of this package becomes larger than necessary, thereby causing such inconvenience that a larger storage place than necessary is required. As a matter of course, this inconvenience can be avoided by piling up a large number of packages. However, piling up a large number of packages tends to cause damage to the bag 1.

Therefore, in the present invention, it is preferred to set the ratio ($h/L_1$) to the above range.

In the present invention, most preferably, the heat-sealed bonded part 3*a* is formed by closing the filling opening 3 at the upper end by heat-sealing. In this case, the head space 5 is generally existent between the top surface of the Si chunks 4 filled in the bag 1 and the heat-sealed bonded part 3*a*. When the ratio ($h/L_1$) is set to the above range, the height of this head space accounts for 20 to 90% of the total height up to the heat-sealed bonded part 3*a* of the bag 1.

In the polysilicon package of the present invention, the inner peripheral length $L_1$ of the bag 1 before the Si chunks 3 are filled can be easily obtained, for example, by cutting out the head space 5 close to the heat-sealed bonded part 3*a* at the upper end and measuring the inner peripheral length of this part. This is because there is substantially no expansion of the polyethylene-based resin film forming the bag 1 in this part. For the same reason, the thrust strength of the polyethylene-based resin film used to form this package can be obtained by cutting out this part and measuring the thrust strength.

Further, in the present invention, to set the maximum expansion of the bag 1 filled with the Si chunks 4 to the above range, the amount of the Si chunks 4 to be filled and the size of the bag 1 are set to suitable ranges to ensure that the above ratio ($h/L_1$) falls within the above range and the Si chunks 4 are filled to ensure that the expansion of the bag 1 is restricted.

Figure 3:
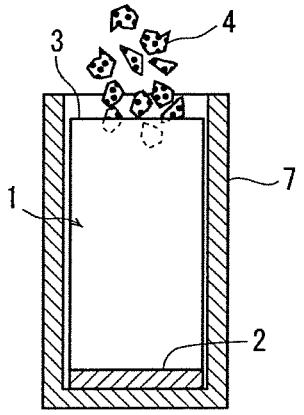
FIG. 3 is a schematic diagram showing a method of filling crushed polysilicon in the bag to obtain the polysilicon package of the present invention.

Stated more specifically, as shown in FIG. 3, while the empty bag 1 before the Si chunks 4 are filled is stored in a frame having an inner peripheral length which is larger than the outer peripheral length of the empty bag and less than 5% (sic) of the outer peripheral length of the empty bag and held in an upright state, the Si chunks 4 should be filled. That is, as excessive deformation caused by filling the Si chunks 4 is suppressed by the frame 7, pressing Si chunks 4 filled later into spaces between the loaded Si chunks filled before is effectively avoided, thereby making it possible to suppress the local expansion of the bag 1 and to set the maximum expansion to the above range.

The frame 7 has a container-like form having an opening at the top in FIG. 3 and may be shaped like a cylinder, and may be mounted on a suitable base.

The inner diameter of the above frame 7 should be a size close to the outer peripheral length of the empty bag 1, for example, the same size as or 1.05 times or less, specifically 1.03 times or less larger than the outer peripheral length of the empty bag 1 in order to prevent deformation caused by filling the Si chunks 4.

Further, the frame 7 should have such stiffness that deformation caused by filling the Si chunks 4 can be suppressed and is preferably made of a synthetic resin in order to prevent the metal contamination of the Si chunks by accidental contact with the Si chunks 4.

The frame 7 is made of polyolefin resin such as polyethylene-based resin or polypropylene-based resin, polyurethane resin, acrylonitrile-butadiene-styrene resin, polyvinyl chloride resin, polycarbonate resin or Teflon (trade name) and has a thickness of 1 mm or more, preferably 1.5 mm or more, more preferably 2 mm or more, to ensure appropriate stiffness.

To prevent the metal contamination of the Si chunks 4, the above synthetic resin is preferably not mixed with additives other than a resin component.

Preferably, the above frame 7 can be opened on the side by hinge attachment in order to enable the bag 1 filled with the Si chunks 4 to be taken out therefrom easily.

After the Si chunks are filled in the bag 1 as described above, the bag 1 filled with the Si chunks is taken out from this frame 7 and the filling opening 3 is heat-sealed to obtain the polysilicon package of the present invention.

In this case, the height of the frame 7 may be set to a size that the filling opening 3 is exposed therefrom so that heat-sealing can be carried out while the bag 1 is stored in the frame 7.

In the polysilicon package of the present invention obtained as described above, the expansion of the bag at the time of filling the Si chunks 4 is suppressed effectively. After the Si chunks 4 are filled to ensure that expansion is suppressed, the mobility of the Si chunks 4 in the bag 1 is low and accordingly the expansion of the bag 1 is hardly caused by the own weight of the Si chunks 4 in the bag 1. Therefore, by suppressing the maximum expansion at the time of filling the Si chunks 4 as described above, damage to the bag can be prevented and the high purity of the Si chunks 4 can be kept at the time of filling the Si chunks 4 and also at the time of storing and transporting the package after that.

The polysilicon package of the present invention may be used as a double structure.

That is, the above-described polysilicon package of the present invention is used as an inner bag and stored in an outer bag to obtain a double package.

In this double package, the outer bag may be formed from the same polyethylene resin film as that of the inner bag (polysilicon package of the present invention). It is particularly preferred that the polyethylene-based resin film of the inner bag and the polyethylene-based resin film of the outer bag should be slippery over each other.

For example, by selecting the type of the polyethylene-based resin to ensure that the coefficient of static friction (JIS-K7125) between these films becomes 0.5 or less, even when the edge of a Si chunk 4 breaks through the inner bag, this force is hardly transmitted to the outer bag directly, thereby making it possible to effectively prevent damage to the outer bag.

To ensure such high slippage, metallocene-catalized LLDPE is preferably used as a film for the inner bag (polysilicon package of the present invention) and a film for the outer bag.

Further, in the above double package, the total of the average thicknesses of the outer bag and the inner bag is preferably 500 μm or less to prevent the bulkiness of the package at the time of transport. In the above embodiment, the average thickness of each of the bags is preferably more than 100 μm and 300 μm or less.

EXAMPLES

The following examples are provided for the purpose of further illustrating the present invention but are in no way to be taken as limiting.

In the examples, the breakage rate of the package was a value measured by the following method.

breakage rate (%) of package;

40 polysilicon packages produced by heat-sealing the filling openings of bags filled with Si chunks by a predetermined method were packed in fives in cardboard boxes, the cardboard boxes were loaded on a truck while a buffer material was inserted into spaces in the cardboard boxes, the Si chunks were taken out by cutting heat-sealed bonded parts at the filling openings of the packages after driving 200 km over an open road, water was injected into the bags from the cut parts, bags having holes from which water was blown out were regarded as broken bags, and the proportion of broken bags in 40 packages was taken as the breakage rate (%) of the packages.

This experiment was carried out 3 times to obtain an average breakage rate (%).

Examples 1 and 2

A metallocene-catalized LLDPE film having a thrust strength (JIS-Z1707) and an average thickness shown in Table 1 was prepared to produce a bag (flat bag or gusset bag) having an inner peripheral length $L_1$ and a length (height) shown in Table 1 therefrom. MFR (190° C.) of the metallocene-catalized LLDPE used to produce the film was 2 g/10 min.

The outer peripheral length of the bag was substantially the same as the inner peripheral length $L_1$ in the flat bag and the gusset bag.

A frame (inner peripheral length of 956 mm) was prepared by using a polyethylene plate-like material having a thickness of 5 mm, the above bag was placed in this frame, 10 kg of Si chunks having an average maximum length shown in Table 1 was filled in the bag manually, and the filling opening of this bag was heat-sealed.

The average breakage rate of the obtained packages was measured, and the measurement results are shown.

The maximum outer peripheral length of each package used in the measurement experiment of the breakage rate was measured and taken as maximum inner peripheral length $L_2$ to calculate the maximum expansion shown in Table 1.

Further, Table 1 also shows the average head space proportion measured for each bag and the average value of the ratio ($h/L_1$) of the loading height "h" of the Si chunks to the inner peripheral length "$L_1$"

Comparative Example 1

A package was manufactured and measured in the same manner as in Example 1 except that Si chunks were filled in the bag without using the frame. The results are shown in Table 1.

TABLE 1

| | | | Example 1 | Example 2 | Comp. Ex. 1 |
|---|---|---|---|---|---|
| Bag | Size: $L_1$ × height (mm) | | 920 × 500 | 920 × 500 | 920 × 500 |
| | Bag form | | flat bag | gusset bag | flat bag |
| | Film material | | metallocene-catalized LLDPE | metallocene-catalized LLDPE | metallocene-catalized LLDPE |
| | Average thickness of film (μm) | | 180 ± 2 | 180 ± 2 | 180 ± 2 |
| | Thrust strength of film (N) | | 10.3 | 10.3 | 10.3 |
| Si chunks | Average maximum length | | 74 | 77 | 76 |
| | Amount (Kg) | | 10 | 10 | 10 |
| Frame | Inner peripheral length (mm) | | 956 | 956 | no frame |
| Package | Ratio ($h/L_1$) | | 0.22 | 0.22 | 0.16 |
| | Head space proportion (%) | | 48 | 47 | 62 |
| | Maximum peripheral length: | Maximum | 945 | 941 | 979 |
| | $L_2$ (mm) | Minimum | 931 | 926 | 969 |
| | Maximum expansion (%) | | 1.2~2.72 | 0.65~2.28 | 5.33~6.41 |
| | Average breakage rate (%) | | 5 | 4 | 14 |

EXPLANATION OF SYMBOLS

1: bag
2: heat-sealed bonded part at lower end
3 filling opening
3*a*: heat-sealed bonded part of filling opening
4: crushed polysilicon
5 head space
7 frame

The invention claimed is:

1. A polysilicon package in which a bag formed from a linear low-density polyethylene (LLDPE)-based resin film having an average thickness of 300 μm or less is filled with crushed polysilicon that is obtained by mechanically crushing a polysilicon rod, wherein:

the bag has a heat-sealed bonded part at a bottom and filled with crushed polysilicon to ensure that a maximum expansion of the bag is not less than 0% but is 5% or less while the bag is held in an upright state with the bottom as a ground contact surface, and the linear low-density polyethylene-based resin film forming the bag is metallocene-catalyzed linear low-density polyethylene.

2. The polysilicon package according to claim 1, wherein the bag has the heat-sealed bonded part at a top opposite to the bottom, and the heat-sealed bonded part at the top is formed by closing after filling crushed polysilicon.

3. The polysilicon package according to claim 2, wherein a ratio ($h/L_1$) of a loading height "h" of the crushed polysilicon filled in the bag to inner peripheral length "$L_1$" of the bag before the crushed polysilicon are filled is 0.1 to more.

4. The polysilicon package according to claim 1, wherein average of maximum length of the crushed polysilicon is 5 to 150 mm.

5. The polysilicon package according to claim 1, wherein polyethylene-based resin film forming the bag has a thrust strength (JIS-Z1707) of 5 N or more.

6. A polysilicon double package in which the polysilicon package of claim 1 is sealed in an outer bag formed from polyethylene-based resin film.

7. A process for producing a polysilicon package, comprising steps of:

holding a bag formed from a linear low-density polyethylene (LLDPE)-based resin film having an average thickness of 300 μm or less in an upright state with a filling opening thereof facing up and a bottom as a ground contact surface when crushed polysilicon that is obtained by mechanically crushing a polysilicon rod are to be filled; and filling crushed polysilicon from the filling opening to ensure that a maximum expansion of the bag is not less than 0% but is 5% or less, wherein the expansion of the bag to be filled with the crushed polysilicon is suppressed by inserting the bag into a frame to fill the crushed polysilicon, and wherein the linear low-density polyethylene-based resin film is metallocene-catalyzed linear low-density polyethylene.

* * * * *